US009810234B2

(12) United States Patent
Bähren et al.

(10) Patent No.: US 9,810,234 B2
(45) Date of Patent: Nov. 7, 2017

(54) FAN IMPELLER

(71) Applicant: punker GmbH, Eckernförde (DE)

(72) Inventors: Henning Bähren, Lübeck (DE); Christian Hornhardt, Dänischenhagen (DE); Matthias Wolf, Kiel (DE); Yingan Xia, Rieseby (DE)

(73) Assignee: Punker GmbH, Eckernförde (DE)

( * ) Notice: Subject to any disclaimer, the term of this patent is extended or adjusted under 35 U.S.C. 154(b) by 505 days.

(21) Appl. No.: 14/482,504

(22) Filed: Sep. 10, 2014

(65) Prior Publication Data

US 2015/0071782 A1 Mar. 12, 2015

(30) Foreign Application Priority Data

Sep. 10, 2013 (EP) ..... 13004398

(51) Int. Cl.
*F04D 29/28* (2006.01)
*F04D 29/30* (2006.01)

(52) U.S. Cl.
CPC ..... *F04D 29/283* (2013.01); *F04D 29/281* (2013.01); *F04D 29/30* (2013.01)

(58) Field of Classification Search
CPC ..... F04D 29/283; F04D 29/30; F04D 29/281
See application file for complete search history.

(56) References Cited

U.S. PATENT DOCUMENTS 9,528,374 B2 * 12/2016 Ikeda ..... F04D 29/281
2014/0023501 A1 * 1/2014 Ikeda ..... F04D 29/281 416/95

FOREIGN PATENT DOCUMENTS

EP 2698543 A1 * 2/2014 ..... F04D 29/281

* cited by examiner

*Primary Examiner* — Ryan J Walters
(74) *Attorney, Agent, or Firm* — Edell, Shapiro & Finnan LLC

(57) ABSTRACT

A fan impeller for the conveyance of a gaseous fluid includes several blades arranged with constant angular spacing around a rotation axis. At least one blade has a boundary zone and an inner zone, together with a bead extending between them along a curved path and/or the boundary zone is determined by a first blade surface and the inner zone is determined by a second blade surface, which are arranged with varying geometry.

22 Claims, 10 Drawing Sheets

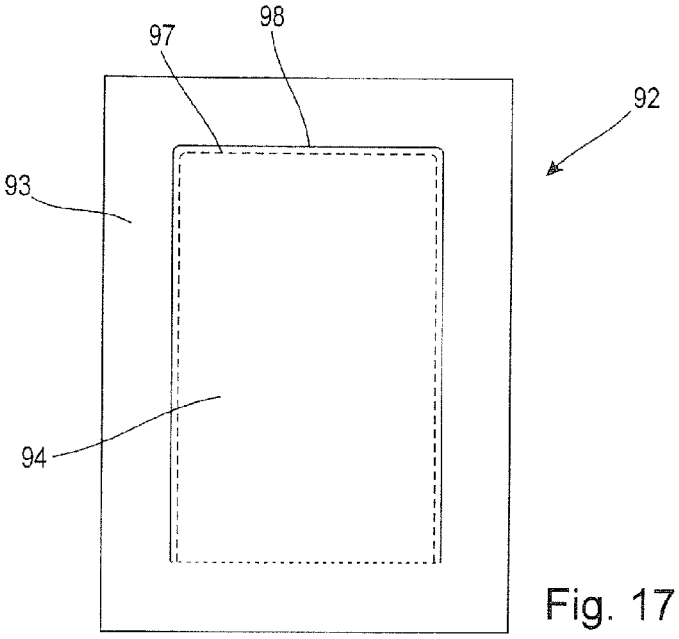
Fig. 17
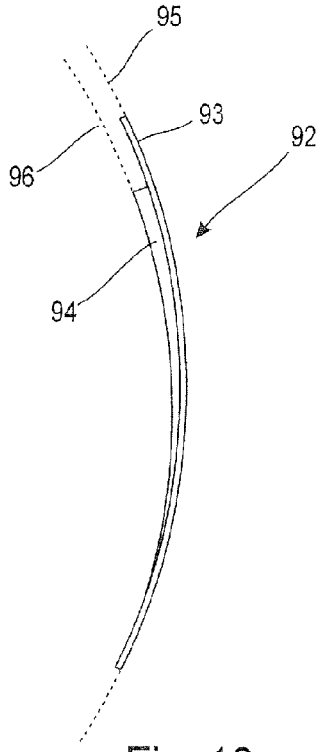
Fig. 18
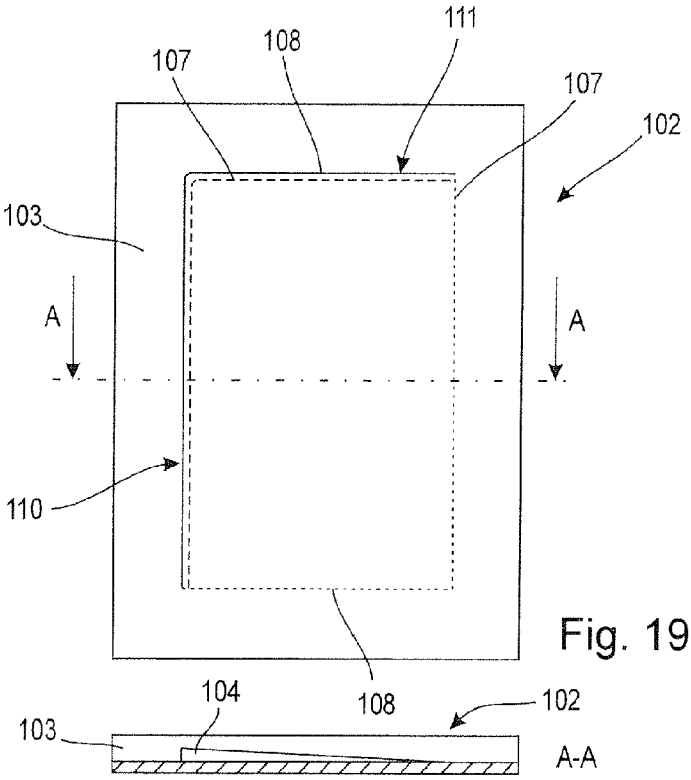
Fig. 19
Fig. 21
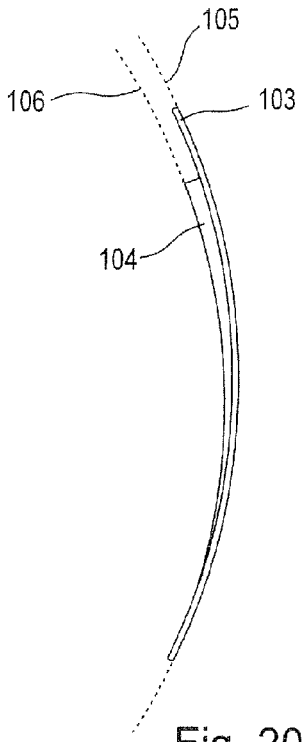
Fig. 20

FAN IMPELLER

CROSS REFERENCE TO RELATED APPLICATIONS

This application claims priority under 35 U.S.C. §119 to Application No. EP 13004398.7 filed on Sep. 10, 2013, entitled "Fan Impeller," the entire contents of which are hereby incorporated by reference.

FIELD OF THE INVENTION

The invention relates to a fan impeller for the conveyance of a gaseous fluid, with several blades arranged with constant angular spacing in an annular space around a rotation axis, and which are fixed to a support means by their axially opposite end sections.

BACKGROUND

A fan impeller of this kind may be in the form of a radial fan impeller, in particular with backwards-bent blades, or also in the form of a drum-type impeller, as known for example from DE 1 628 336 A. Here, the drum-type impeller consists of a large number of narrow vanes which form the blades of the wheel and are fixed between two end rings, the radius of which is significantly greater than the width of the vanes, so that a drum-shaped construction is formed, and connected in a suitable manner to a hub, e.g., with the aid of a circular plate which is fastened to the vanes at their center.

SUMMARY

The problem of the invention is to provide an improved fan impeller, in particular with reduced weight, preferably with a lightweight structure.

This problem is solved for a fan impeller of the type described above by the features of claim 1. Here it is provided that at least one blade has a continuous boundary zone, in particular frame-like, and at least one inner zone surrounded by the boundary zone wherein, between the boundary zone and the inner zone at least one bead is provided along a curve path which is at least L-shaped, preferably U-shaped and in particular continuous, and/or wherein the boundary zone is determined by a first blade surface and the inner zone is determined by a second blade surface which is arranged and/or formed with a geometry differing from that of the first blade surface.

The function of the bead or beads is to virtually maintain the mechanical stability of the blades while simultaneously reducing the amount of material, in particular the material thickness. This makes possible a lighter design for the fan impeller, with at least largely constant strength, in particular the same or better. Due to the sought-after lightweight structure for the fan impeller it is possible to have a positive influence on a fan equipped with a corresponding fan impeller, as compared with a known fan impeller. This is due to the fact that a lower fan impeller weight, with a given fluid mass flow to be conveyed by the fan impeller, is accompanied by a reduced demand for driving power. Moreover the bead, depending on the shape of the curve path, which is at least L-shaped and therefore comprises two curved or straight legs, inclined at an angle to and merging into one another, may additionally or alternatively provide an advantageous aerodynamic effect. By way of example the blade has a base area which is at least substantially rectangular wherein the inner zone, similarly for example rectangular, is delimited at least partly from a frame-like continuous boundary zone by the bead. In the case of an L-shaped curve path for the bead, the first blade surface of the boundary zone and the second blade surface of the inner zone bound a wedge-like section running together at an angle in two directions in space. In the case of a bead with a U-shaped curve path, the two blade surfaces preferably form a volume section running together in a wedge shape in one spatial direction. In the event of a bead with a continuous curve path, the two blade surfaces may bound a ring-section-shaped area of space. At the same time it is always provided that at least one of the blade surfaces is provided with a curvature in at least one spatial direction. Additionally or alternatively it is provided that the blade surfaces of the boundary zone and the inner zone are arranged and/or designed with geometrical difference from one another, so that at the blades at least two surface sections differing from one another are formed, which also have a differing aerodynamic effect in operation of the fan impeller.

It is expedient for the first and/or the second blade surface to be designed in at least one cross-sectional plane with a steady, in particular constant, curvature. Depending on the aerodynamic demands on the fan impeller it may for example be provided that the first blade surface has a constant curvature in a first cross-sectional plane, and no curvature in a second cross-sectional plane aligned at right-angles to the first cross-sectional plane. In similar fashion, such a design may also be provided for the second blade surface, thus ensuring a similar method of manufacture for the blades. It is especially advantageous for at least one of the blade surfaces to have a constant curvature in the respective cross-sectional plane since by this means an especially cost-efficient production of a press mold for the blade concerned may be ensured, in particular involving deep-drawing from a piece of sheet metal.

In an advantageous development of the invention it is provided that the curvature or curvatures of the first blade surface and the curvature or curvatures of the second blade surface are similar in form. For example, it may be provided in this connection for the two blade surfaces to be congruent or geometrically identical, so that both blade surfaces for example have the same curve radius in the same cross-sectional plane. Alternatively it may be provided that the two blade surfaces are geometrically similar and in particular have a common curve center point in a common cross-sectional plane.

It is advantageous if the first and second blade surfaces are equidistant from one another. This makes it possible to obtain an advantageous combination of a simple method of manufacture and favorable aerodynamic properties.

In a further variant it is provided that the bead has a constant width and/or a constant depth, in particular a constant cross-section, along the curve path.

In an advantageous development of the invention it is provided that the first blade surface is curved in precisely one cross-sectional plane and that the second blade surface us curved in two cross-sectional planes perpendicular to one another. Due to the design of the first blade surface with precisely one curve, advantageous fitting in the support means is ensured, since here it is not necessary to make allowance for two curves. On the other hand it is advantageous when the aerodynamically more important second blade surface, which determines the geometry of the inner zone of the blade, has curves in two spatial directions, in order to make possible an especially advantageous aerodynamic behavior of the blade in the fan impeller. Therefore, even with a simple design of the support means, it is possible to obtain a complex aerodynamic geometry for the fan impeller through suitably formed blades.

In a further variant of the invention it is provided that the bead has a varying width and a varying depth along the curve path, in particular a constantly varying cross-section. By this means the stabilization effect which it is intended that the bead should provide may be preset variably in sections, in order to facilitate advantageous adaptation of the blade geometry to different requirements in certain sections. This is achieved in particular when the bead has a constantly varying cross-section along the curve path, since by this means stress peaks in the blade material may be reduced or avoided altogether, as might occur with a discontinuous forming of the bead.

In a further variant of the invention it is provided that the support means are provided with recesses to hold axial end sections of the blades, wherein the recesses are each formed at the base of a curved bead matched to the corresponding blade surface. By this means an advantageous force transfer between the support means and the blades is facilitated, so that an advantageous increase in stability may be obtained as compared with support means without suitable beads. The geometry for the curvature of the bead is based on the geometrical intersection of the blade with the respective support means, wherein the bead may have a constant or variable cross-section along the curve.

Preferably it is provided that at least one, preferably star-shaped, impression is made on the support means. With the aid of such an impression, the support means may also be stabilized apart from the beads to hold the blades without using additional material.

In a further variant of the invention it is provided that the blades are recessed in the support means in the direction of the support means lying opposite. By this means, fixing of the blades to the support means is simplified in cases where it is intended to fix the blades after axial insertion in the support means by material bonding, in particular by welding. Due to the beads in the support means, not only is a stabilization of the connection between support means and blade obtained, but also a volume of space is created apart from a preferably disc-shaped outer surface of the support means, into which the axial end section of the blade can extend. Also located in this volume of space is the weld bead created during welding of the blade to the support means, without the need for re-machining of this weld bead to ensure an aerodynamically smooth surface of the support means. Preferably it may be provided that the volume of space formed by the bead and filled at least partly by the axial end section of the blade, may be filled completely and flush with the smooth outer surface of the support means in a downstream step using material bonding, in particular by introducing a curable, shapeless compound, for example a plastic filling compound.

In an advantageous development of the invention it is provided that the bead or beads is or are formed in the blade facing inwards in the radial direction. This produces an advantageous combination of a stabilization effect due to the bead and an influence of the aerodynamic behavior of the combination of blade and bead on the fan impeller which is as low as possible.

It is expedient for the blade to be provided with at least one bead facing radially inwards and at least one bead facing radially outwards. In this way an especially advantageous stabilization effect for the blades of the fan impeller may be obtained.

In a further variant of the invention it is provided that the boundary zone is offset radially inwards relative to the inner zone.

It is advantageous when the first support means is in the form of a plate- or ring-shaped round sheet-metal blank for non-rotatable coupling to a drive shaft, and the second support means is designed as a ring, in particular as a torus ring section, with a curvature which is rotation-symmetrical to the rotation axis.

In a further variant of the invention it is provided that the two support means, together with the blades, in particular of similar design, form a radial impeller.

BRIEF DESCRIPTION OF THE DRAWINGS

Advantageous embodiments of the invention are depicted in the drawings, showing in:

FIG. 17, a schematic top view of a blade in which the bead follows a U-shaped curve path;

FIG. 18, a schematic side view of the blade according to FIG. 17;

FIG. 19, a schematic top view of a blade in which the bead follows an L-shaped curve path;

FIG. 20, a schematic side view of the blade according to FIG. 19; and

FIG. 21, a schematic sectional view of the blade according to FIG. 19.

DETAILED DESCRIPTION

Figure 1:
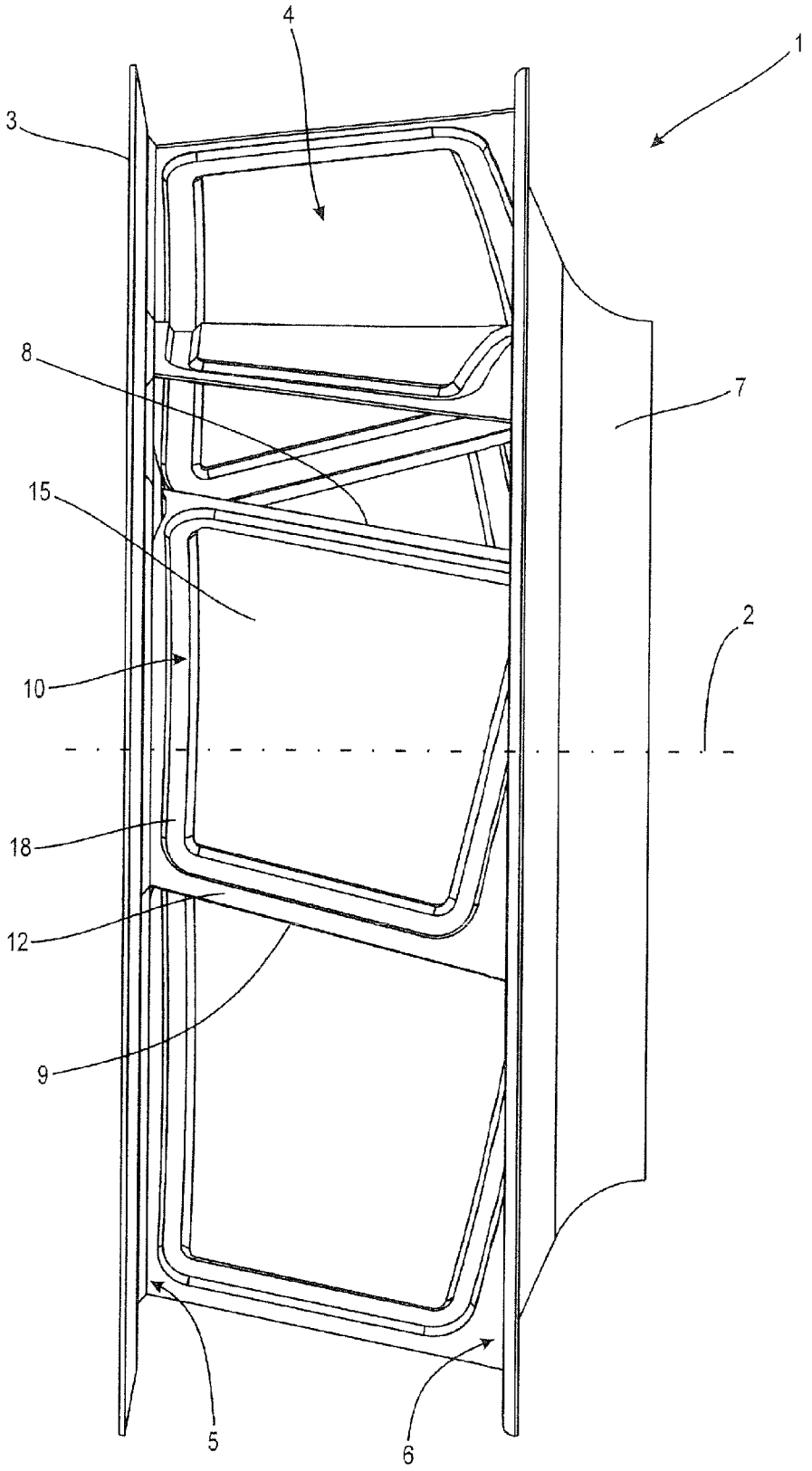
FIG. 1, a first embodiment of a fan impeller with several blades arranged with constant angle spacing around a rotation axis, together with a round sheet-metal blank and a ring for fixing the end sections of the blades.
Figure 2:
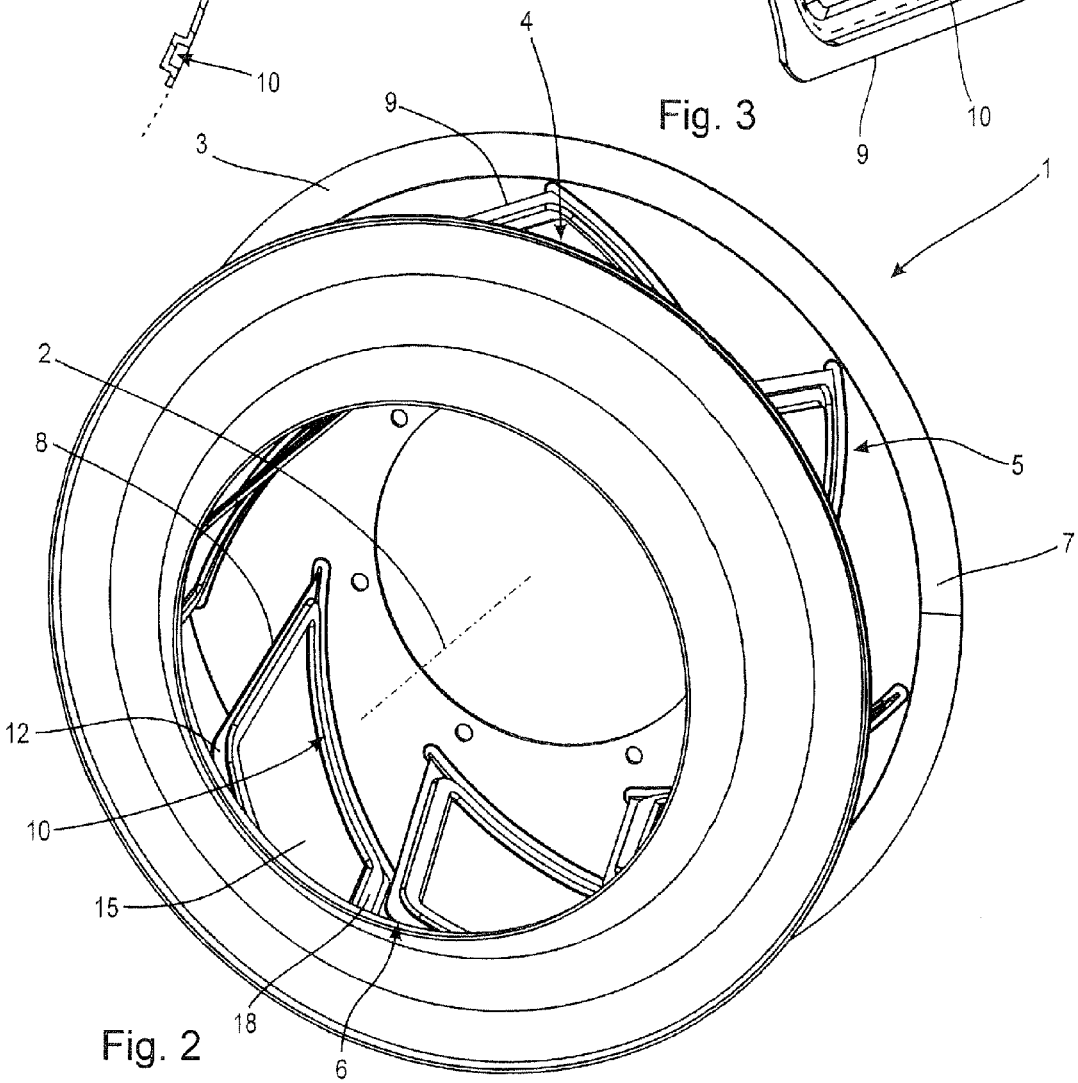
FIG. 2, a perspective view of the fan impeller according to FIG. 1.

Shown in FIGS. 1 and 2 is a fan impeller 1, by way of example in the form of a radial impeller, which is designed for the conveyance of a gaseous fluid and is provided for rotation around a rotation axis 2. The fan impeller 1 has a rotation-symmetrical round sheet-metal blank, for example annular, which is provided for a connection with axial end sections 5 of blades 4 and is designed for attaching to a hub, not shown, so that the fan impeller 1 may be fixed to a drive shaft, also not shown, of for example an electrical drive motor.

The blades 4 are also fixed by axial end sections 6, which lie opposite the axial end sections 5, to a ring 7, for example rotation-symmetrical.

The ring 7 is in the form of an inlet nozzle in a radially inner zone, and has for this purpose a ring area which is at least substantially torus-section-shaped. In order to facilitate even conveyance of the gaseous fluid, the blades 4 are arranged with constant angular spacing around the rotation axis 2 and bound, with their radially inner blade edges 8 and their radially outer blade edges 9, an annular volume of space, not described in detail, in which in the course of rotation of the fan impeller around the rotation axis, the acceleration necessary to convey the gaseous fluid is applied to that gaseous fluid.

By way of example the round sheet-metal blank 3, the blades 4 and the ring 7 are made as sheet-metal parts and joined together by material bonding, in particular by welding, so as to be dimensionally stable.

Figure 3:
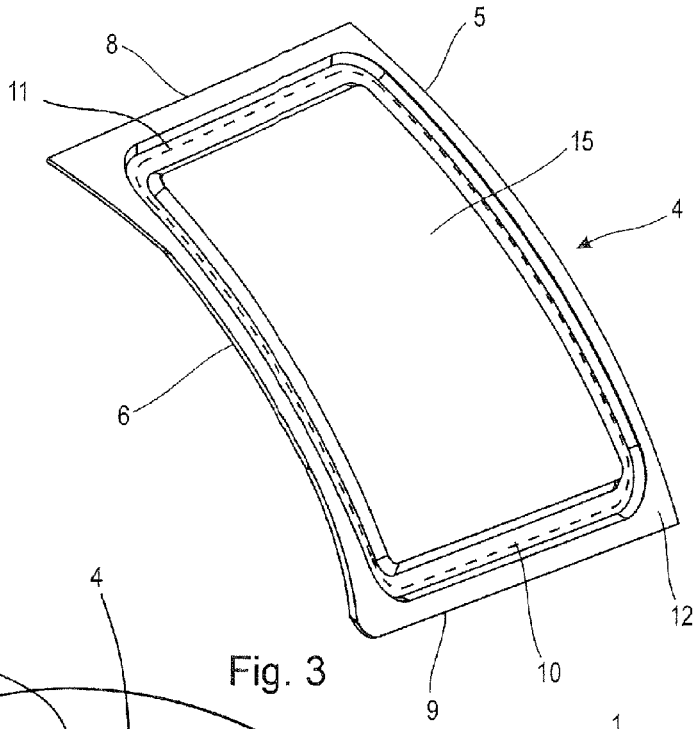
FIG. 3, a perspective view of a blade, as used in the fan impeller according to FIGS. 1 and 2.

So as to ensure for the fan impeller 1, with low weight, high mechanical stability even at high speeds, the blades 4 are provided with a bead 10 which follows a curve path 11, by way of example substantially rectangular and shown in detail in FIG. 3. In so doing, the bead 10 separates a boundary zone 12, for example frame-like, from an inner zone 15, for example rectangular, as may be seen in particular in FIG. 3.

Figure 4:
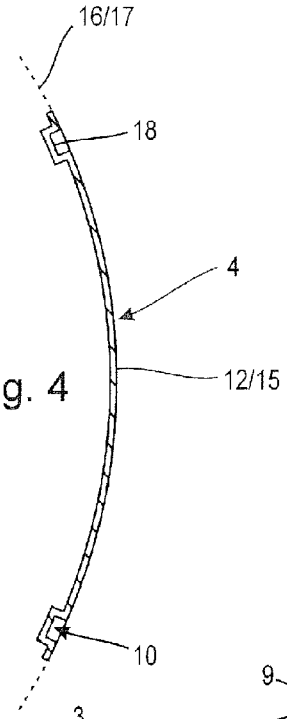
FIG. 4, a sectional view of the blade according to FIG. 3.

FIG. 4 reveals that, in this first embodiment of a fan impeller 1, the blades 4 are so designed that a first blade surface 16 determined by the boundary zone 12 and a second blade surface 17 determined by the inner zone are geometrically identical, so that both blade surfaces 16, 17 cover the whole surface of the blade 4 apart from the bead 10. It is also provided that both the first blade surface 16 and also the second blade surface 17 have no curvature in a cross-sectional plane, not shown, which includes the rotation axis 2 of the fan impeller 1. On the other hand it may be gathered from FIG. 4 that the blade 4, which is aligned perpendicular to the rotation axis 2 of the fan impeller 1, has a uniform curvature for the two blade surfaces 16, 17, which by way of example are arranged concentric to one another and therefore congruent.

It is moreover provided that the bead 10 has a constant width and also a constant depth along the curve path 11, so that a frame-like base area 18 of the bead 10 is geometrically similar to the first and second blade surfaces 16, 17.

By means of this structuring of the blades 4 for the fan impeller 1 it is possible to obtain a reduction in the material needed for the blades 4, while maintaining the strength requirements as determined by the respective application of the fan impeller 1. Consequently the overall weight of the fan impeller 1 may be reduced without this involving the need to take into account any loss of stability or reduced life expectancy for the fan impeller.

Figure 5:
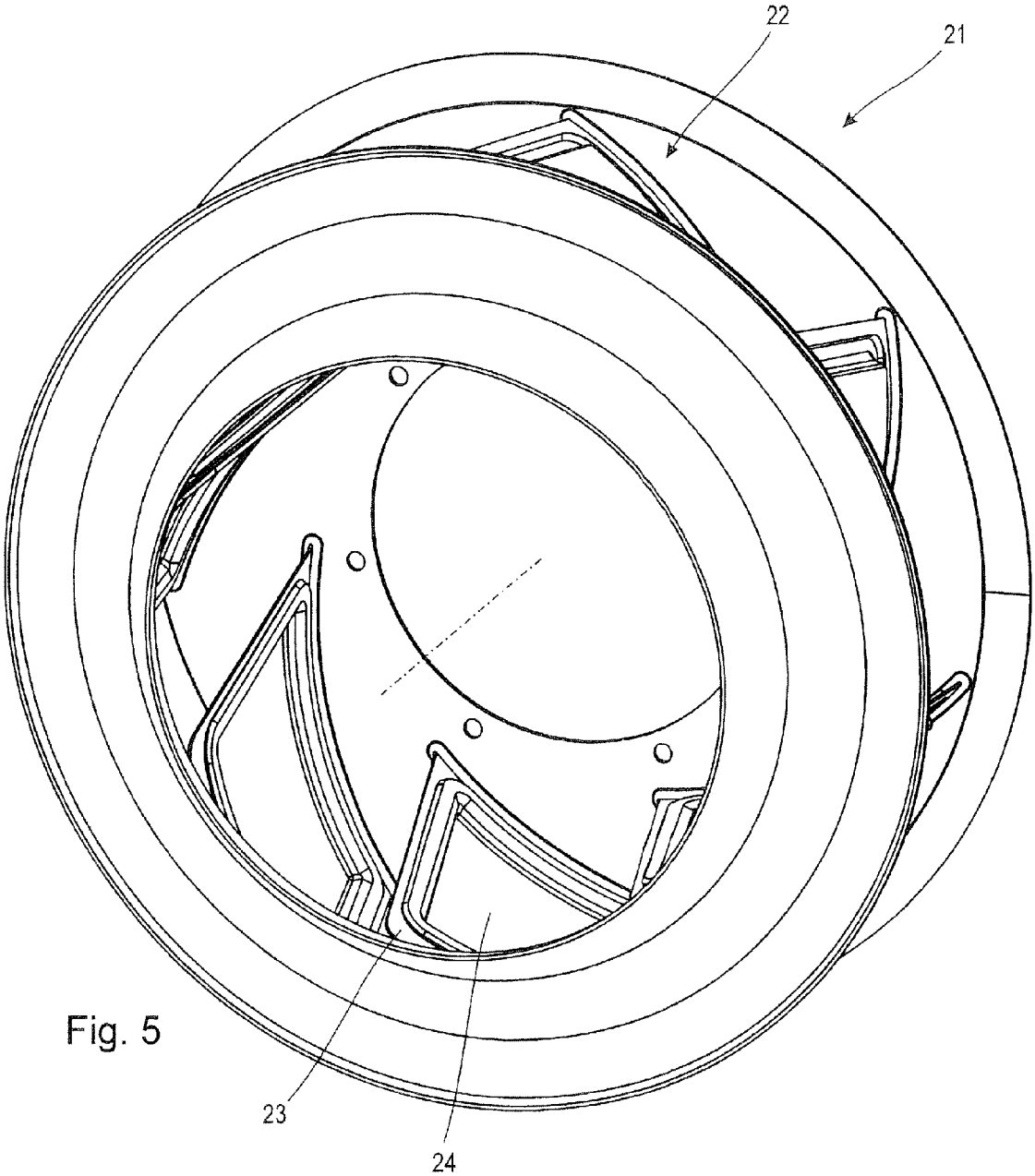
FIG. 5, a second embodiment of a fan impeller with blades, in which the inner zone and the boundary zone are radially offset from one another.

In the second embodiment of a fan impeller 21 shown in FIG. 5, also in all other embodiments of fan impellers as disclosed in the further figures, reference is made only to the difference in design as compared with the fan impeller 1 shown in FIGS. 1 to 3.

Figure 6:
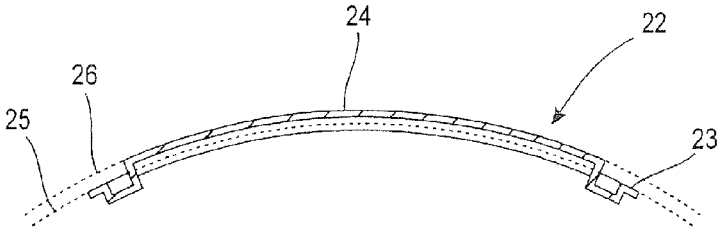
FIG. 6, a sectional view of a blade used in the second embodiment of the fan impeller.

The fan impeller 21 differs from the fan impeller 1 in respect of the design of its blades 22, due to the fact that the boundary zone 23 and the inner zone 24 determine two geometrically similar blade surfaces 25, 26, equidistant from one another, as disclosed in particular by the side view of blade 22 according to FIG. 6. Otherwise the blade 22 has the same geometrical properties as blade 4, in particular in respect of its curvature in only one spatial direction. Moreover the blade surfaces 25, 26, on account of their equidistant spacing, are aligned concentric to one another and have curve radii which differ in their amount by the spacing of the two blade surfaces 25, 26.

Figure 8:
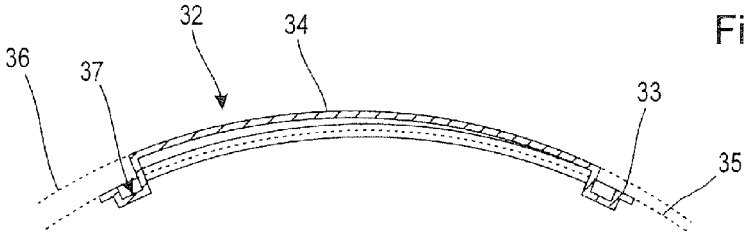
FIG. 8, a first sectional view of a blade used in the third embodiment of the fan impeller.
Figure 7:
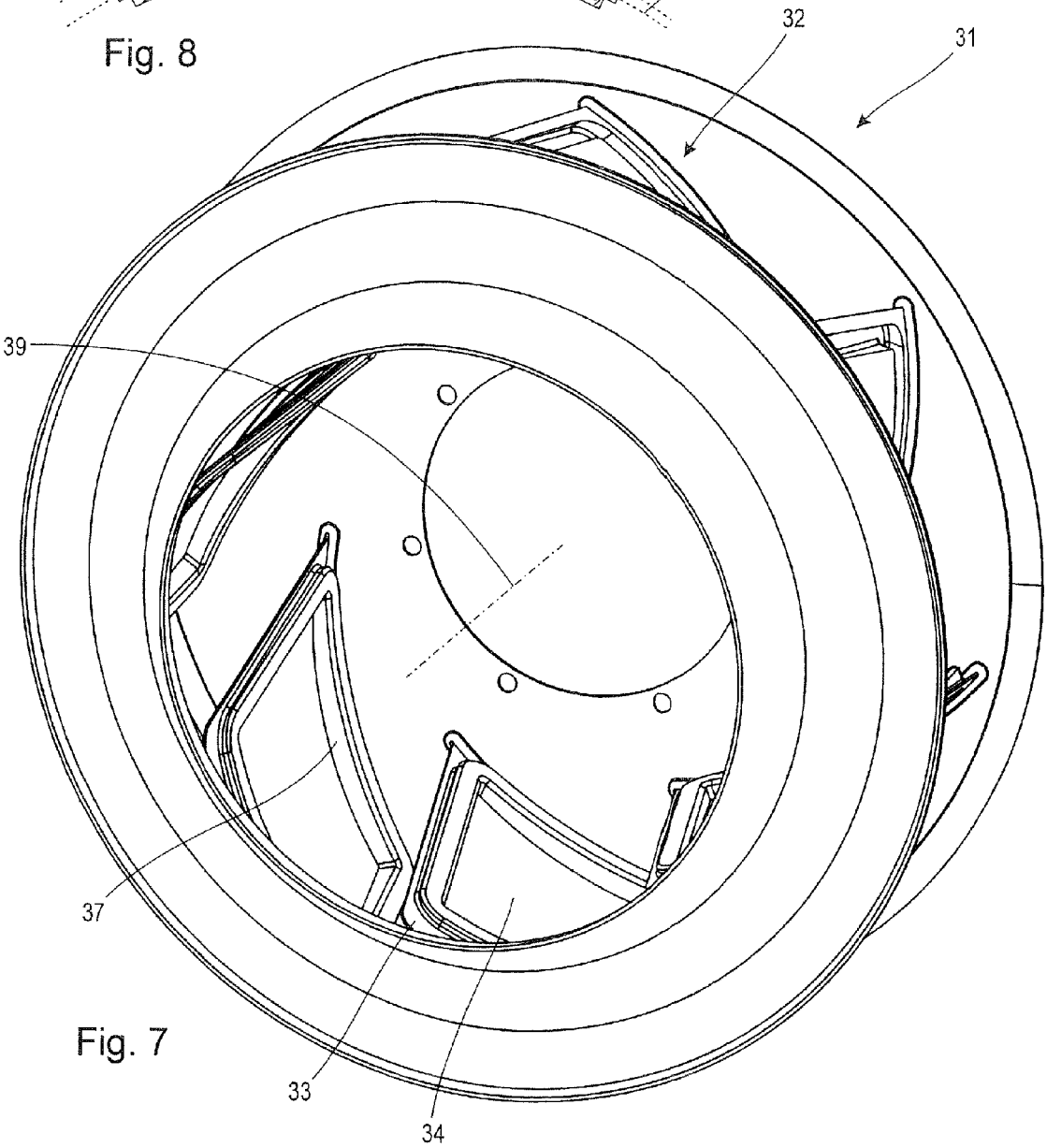
FIG. 7, a third embodiment of a fan impeller with blades, in which the inner zone and the outer zone are aligned at an angle to one another.

In the third embodiment of a fan impeller 31 shown in FIG. 7, the blades 32 are so designed that a boundary zone 33 and an inner zone 34 respectively determine a first blade surface 35 and a second blade surface 36 which are aligned at an angle to one another. This also results in the fact that the bead 37 has a variable depth along the curve path 38 which is for example similarly substantially rectangular. As may be inferred from FIGS. 8 and 9, the curves of the blade surfaces 35 and 36 are arranged eccentric to one another in a cross-sectional plane which includes the rotation axis 39 of the fan impeller 31. In addition, the blade surfaces 35 and 36 enclose an acute angle, according to the view of FIG. 9, in a cross-sectional plane, not shown, aligned perpendicular to the rotation axis 39.

Figure 11:
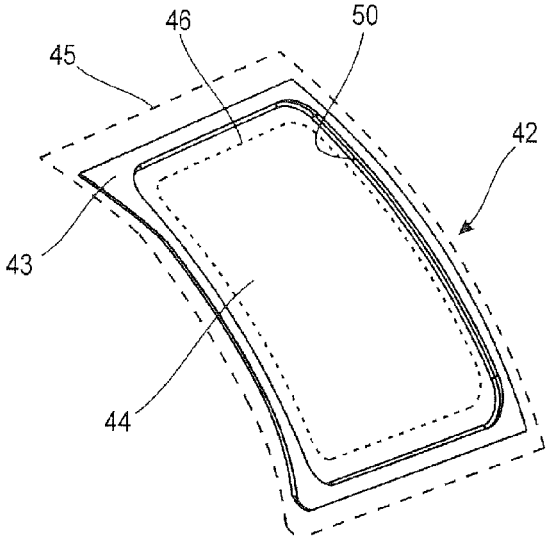
FIG. 11, a blade for use in the fan impeller according to FIG. 10 with single-step impression.
Figure 10:
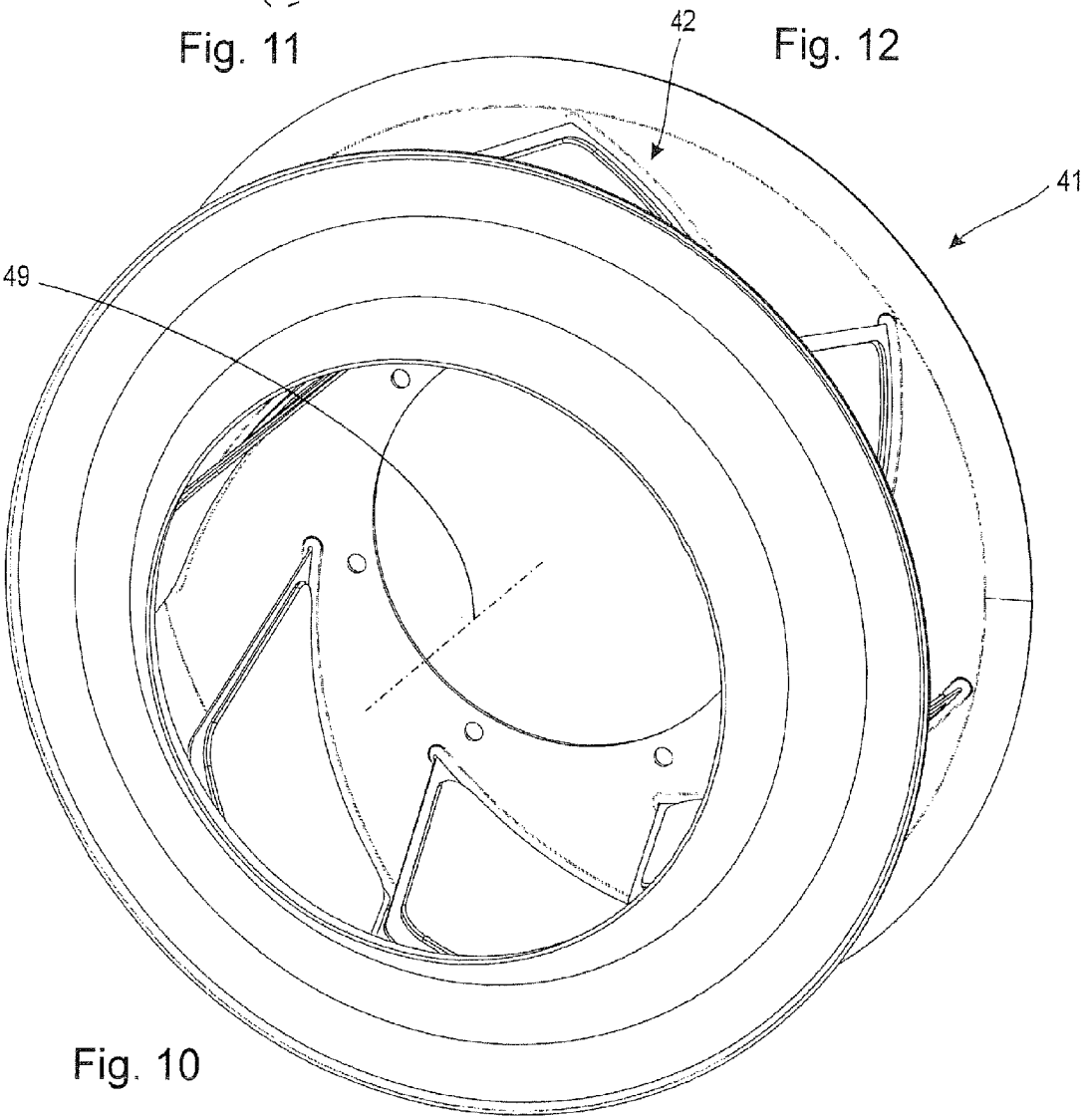
FIG. 10, a fourth embodiment of a fan impeller with blades and with a single-step impression.

In the fourth embodiment of a fan impeller 41 according to FIG. 10, the blade 42 shown in more detail in FIG. 11 is provided with a single-step impression, by means of which the inner zone 44 is offset from the boundary zone 43. By way of example it is provided that the blade surface 46 determined by the inner zone 44 is offset evenly by a preset amount and therefore equidistant from the blade surface 45 determined by the inner zone 43. Preferably the two blade surfaces 45 and 46 are geometrically similar in form. Furthermore, it is provided for example that the two blade surfaces 45, 46 have no curvature in a cross-sectional plane which includes the rotation axis 49 of the fan impeller 41. It is also provided for example that the two blade surfaces 45, 46 are each curved in the same geometrically similar manner in a cross-sectional plane aligned perpendicular to the rotation axis 49. In an embodiment of a blade, not shown, which is designed with an impression in accordance with the variant according to FIGS. 10 and 11, it is also possible to provide an angled impression for the inner zone relative to the boundary zone, which would lead to a boundary zone 50, visible in FIG. 11 where it runs around at a constant height, having a curve path of variable height in the embodiment which is not depicted.

Figure 12:
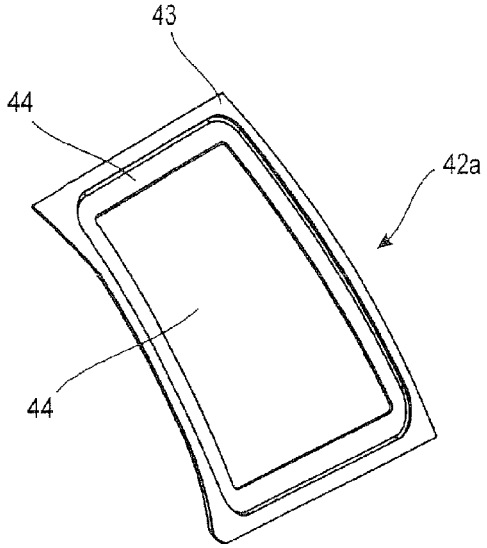
FIG. 12, a blade with two-step impression.

In the variant shown in FIG. 12 of the blade 42 shown in FIGS. 10 and 11, the blade **42*a* is made with a second impression, by which a further inner zone 44*a* with a further blade surface, not shown in detail, is determined. By way of example it is provided that the inner zone 44*a* is made similar to the inner zone 44, as provided in FIG. 11 as a uniform surface and in FIG. 12 as a frame-like continuous surface area. The boundary zone 43 of the blade 42*a* is identical to the boundary zone 43 of the blade 42. In an embodiment, not shown, of the blade according to FIG. 8**, a steep arrangement of the altogether three blade surfaces to one another may be provided, if this is necessary for example due to aerodynamic requirements or enhanced specifications in respect of the stability of the blade.

Figure 13:
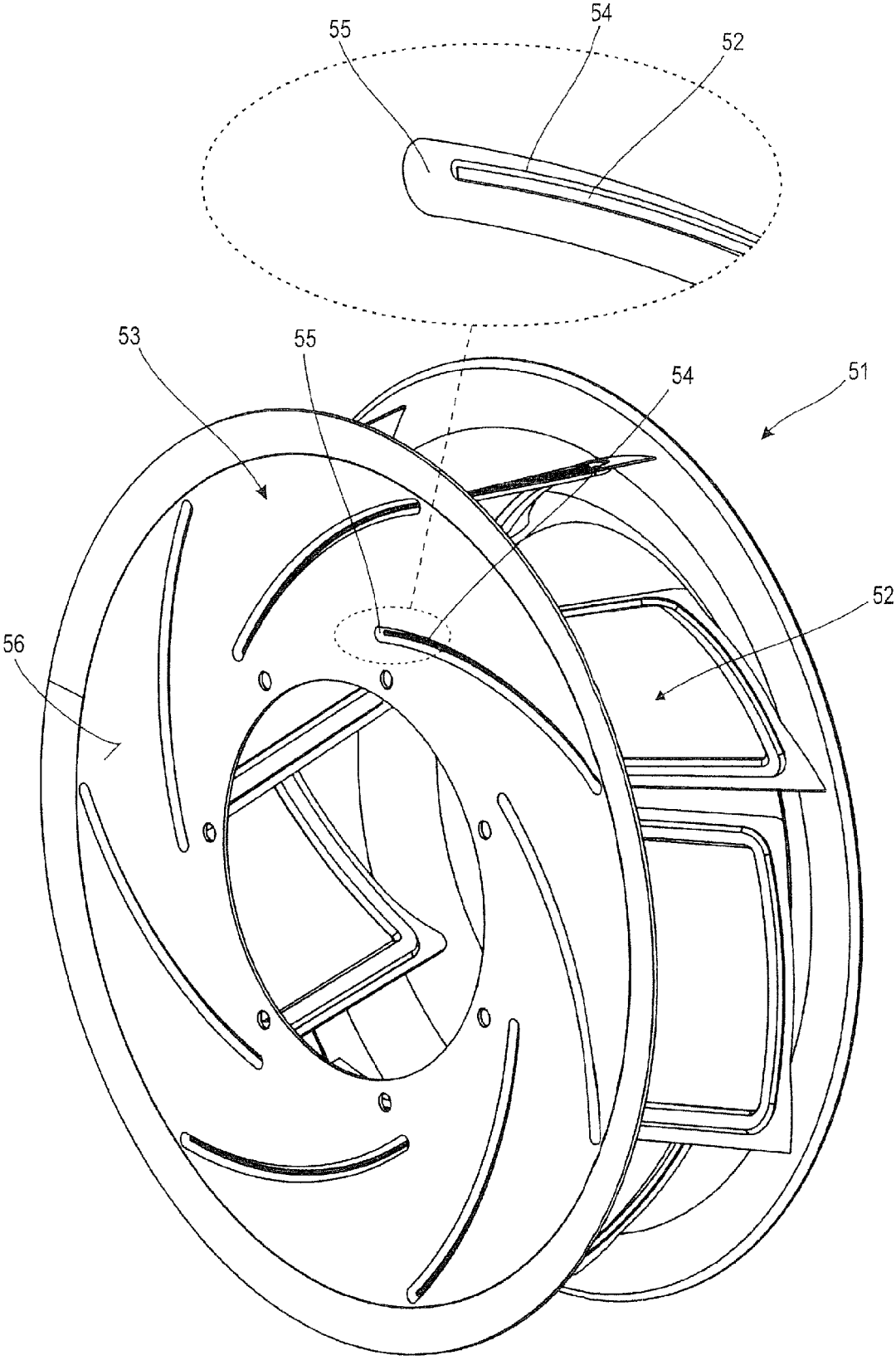
FIG. 13, a fifth embodiment of a fan impeller with beads in the round sheet-metal blank for holding the axial end sections of the blades.

In the fifth embodiment of a fan impeller 51 shown in FIG. 13, the blades 52 are each inserted by an axial end section into the round sheet-metal blank 53. For this purpose, arc-shaped recesses in the nature of slots are formed in the round sheet-metal blank 53 and in terms of their curve path are matched to the curvature of the blades 52 and in respect of their slot width conform to the material thickness of the blades 52. The recesses 54 are each made at the base of beads 55 which surround the recesses 54. In the fifth embodiment of the fan impeller 51 it is provided that the beads 55 have along their respective curve paths, which coincide with the recesses 54, a constant width and a constant depth, in particular therefore a constant cross-section. In addition it is provided by way of example that the beads 55 are impressed in the round sheet-metal blank 53 in the direction of the blades 52, by which means, based on a round sheet-metal blank surface 56 which by way of example is circular-arc-shaped in form, a recessed arrangement of the axial end sections of the blades 52 is made possible. Moreover the beads 55 permit welding of the axial end sections of the 52 to the round sheet-metal blank 53, without this causing the weld bead resulting from the welding operation to protrude above the round sheet-metal blank surface 56.

Figure 14:
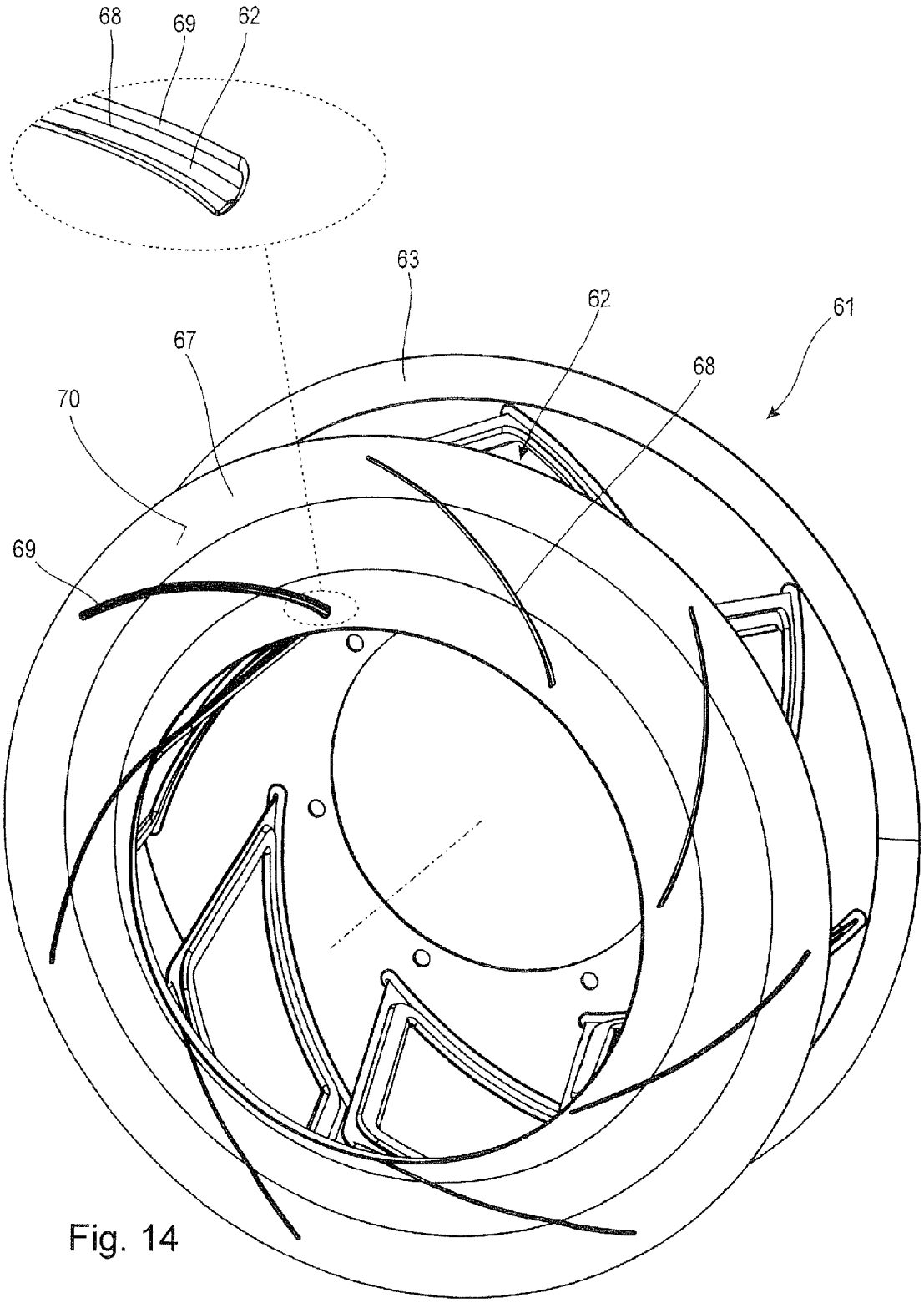
FIG. 14, a sixth embodiment of a fan impeller with beads in the ting and in the round sheet-metal blank for holding the axial end sections of the blades.

In the sixth embodiment of a fan impeller 61 shown in FIG. 14, the blades 62 are inserted on both sides by their axial end sections into both the round sheet-metal blank 63 and also the ring 67, with the round sheet-metal blank 63 being of the same design as the round sheet-metal blank 53 of the fifth embodiment of the fan impeller 51. In the sixth embodiment of the fan impeller 61, the ring 67 is also provided with recesses 68, which pass through the ring 67 and make possible the insertion of the respective axial end section of the blades 62. For stable holding of the axial end sections of the blades 62, the recesses 68 are each located at the base of a bead 69, so that on insertion of the axial end sections of the blades 62 and also in joining of the blades 62 to the ring 67 by material bonding, in particular by welding, no elevations are created on the rotation-symmetric ring surface 70.

Figure 15:
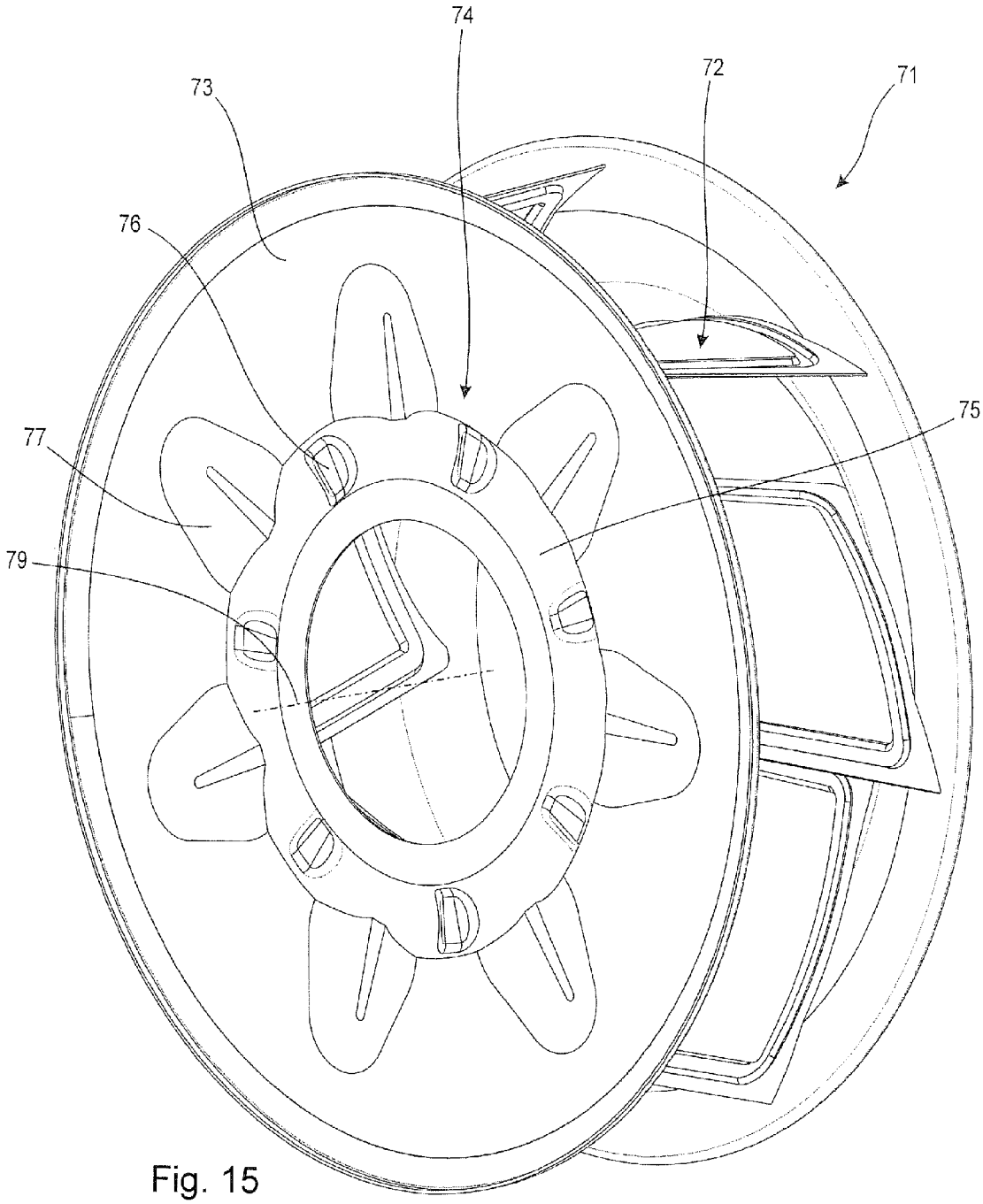
FIG. 15, a seventh embodiment of the fan impeller with an impression in the round sheet-metal blank.

In the seventh embodiment of a fan impeller 71 shown in FIG. 15, an impression 74 to reinforce the stability of the round sheet-metal blank 73 is provided on the latter. The impression 74 includes for example an annular bead 75 running concentric to the rotation axis and recessed in the direction of the blades 72. The bead 75 is divided by radial lateral webs 76, which are raised above the bead 75 in a direction facing away from the blades 72. Provided on an outer boundary zone of the bead 75 are beads 77, extending radially outwards in a star shape and also impressed into the round sheet-metal blank 73 in the direction of the blades 72, with each having a narrow inner zone with greater bead thickness and an outer zone with lesser bead thickness surrounding the inner zone.

Figure 9:
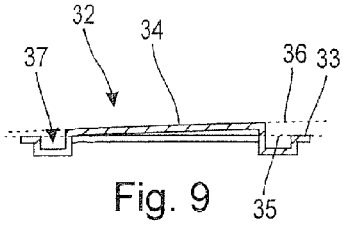
FIG. 9, a second sectional view of a blade used in the third embodiment of the fan impeller.
Figure 16:
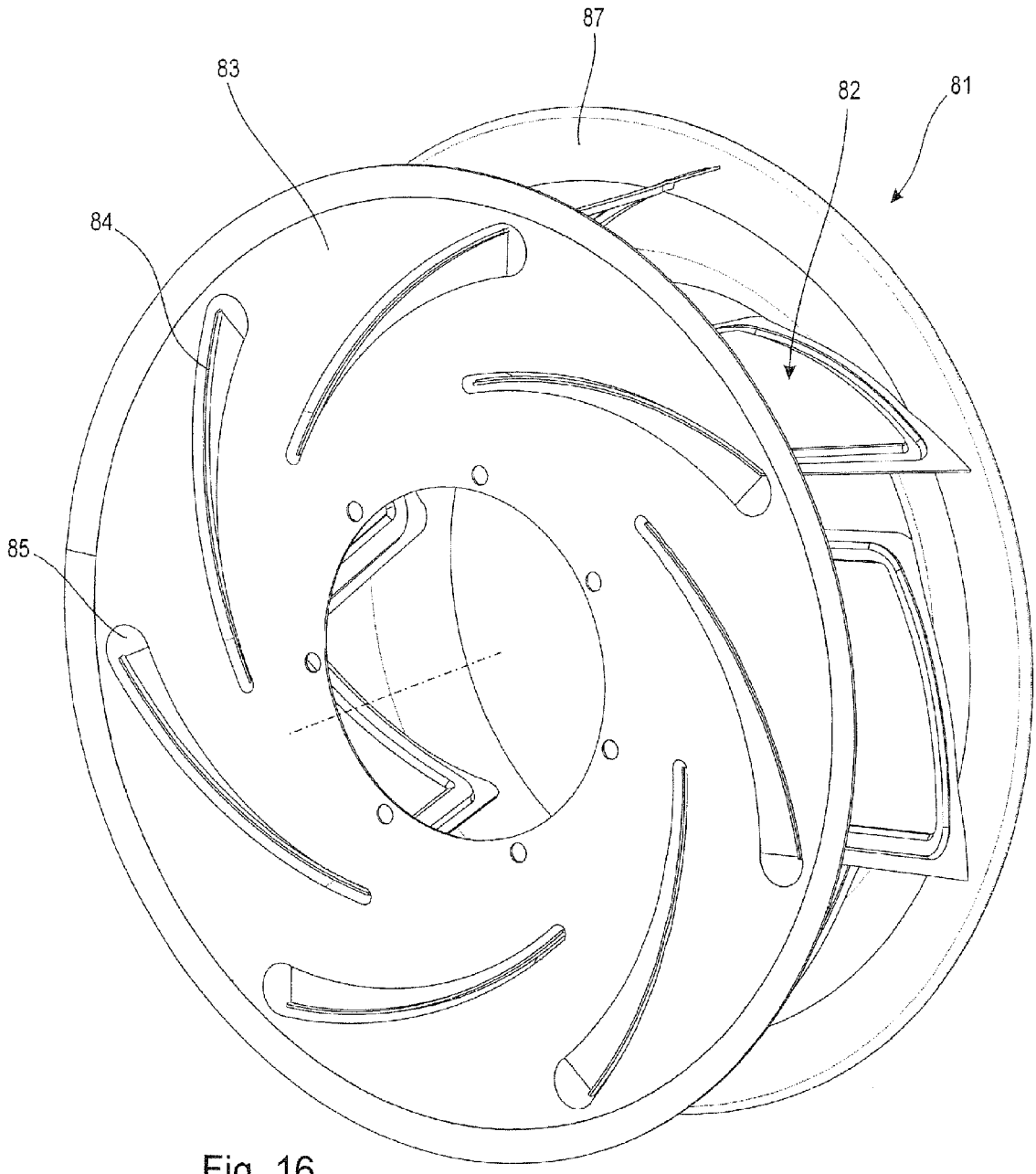
FIG. 16, an eighth embodiment of a fan impeller with beads which have a varying cross-section in the round sheet-metal blank.

In the eighth embodiment of a fan impeller 81 shown in FIG. 16, the blades 82 are inserted through the round sheet-metal blank 83 by axial end sections, for this purpose the round sheet-metal blank 83 has recesses 84 with curve paths corresponding to the curvature of the blades 82. The recesses 84 are in each case provided at the base of beads 85, while the beads 85 have variable width and depth along their curve path, unlike the design of the beads 55 in the fifth embodiment of a fan impeller 51, as shown in FIG. 9. By way of example it is provided that the beads 85 are designed to start from a radial inner zone with lesser width and lesser depth, moving towards a radially outer zone with greater width and greater depth. Moreover, the beads 85 are impressed into the round sheet-metal blank 83 in the direction of the blades 82 so that, in the aerodynamically effective flow space bounded by the blades 82, the round sheet-metal blank 83 and the ring 87, an advantageous aerodynamic effect is produced by the beads 85. In an embodiment of the invention which is not shown, more additional beads are provided in the round sheet-metal blank and/or ring. They are also impressed in the direction of the blades and are likewise provided to influence the aerodynamic properties.

In the embodiment of a blade 92 shown in FIGS. 17 and 18, the boundary zone 93 surrounds the inner zone 94 in the manner of a frame. Here the inner zone is so formed that the blade surface 96 of the inner zone 94 is tilted relative to the blade surface 95 of the boundary zone 93. By way of example, a steady transition is provided between boundary zone 93 and inner zone 94, also the inner zone 94 is separated from the boundary zone 93 by a bead 98 which follows a U-shaped curve path 97. The bead 98 has by way of example a constant width and a variable depth.

In the embodiment of a blade 102 shown in FIGS. 19, 20 and 21, the inner zone 104 is tilted relative to the boundary zone 103, but has at the two edges 107 and 108, shown by broken lines, a steady transition between the blade surface 105 of the boundary zone 103 and the blade surface 106 of the inner zone 104. This results in an L-shaped bead 109, which here comprises two straight legs 110 and 111, with a bead depth at its greatest at an intersection point of the two legs 110 and 111.

What is claimed is:

1. A fan impeller for conveying a gaseous fluid, comprising:

first and second supports; and a plurality of deep-drawn sheet-metal blades having first and second axial end sections, each of the blades extending between the first and second supports and being respectively affixed to the first and second supports along the first and second axial end sections, the blades being arranged with a constant angular spacing in an annular space around a rotation axis;

wherein at least one of the blades comprises a sheet-metal part shaped to have a continuous boundary zone extending along a periphery of the blade and at least one inner zone surrounded by the boundary zone; and wherein the sheet-metal part further comprises at least one bead that lies between the boundary zone and the inner zone along a curved path having at least a portion that is substantially L-shaped.

2. The fan impeller of claim 1, wherein at least one of the first and second blade surfaces has a constant curvature in at least one cross-sectional plane.

3. The fan impeller of claim 1, wherein the boundary zone is frame-like and the curved path for the at least one bead is or continuous.

4. The fan impeller of claim 3, wherein at least one of the first and second blade surfaces has a constant curvature in at least one cross-sectional plane.

5. The fan impeller of claim 3, wherein the curvatures of the first and second blade surfaces are similar in form.

6. The fan impeller of claim 5, wherein the first blade surface is shaped as a portion of a first cylinder and the second blade surface is shaped as portion of a second cylinder that is concentric with the first cylinder.

7. The fan impeller of claim 1, wherein the bead has a constant width and/or a constant depth along the curved path.

8. The fan impeller of claim 1, wherein the first blade surface is curved in only one of two perpendicular cross-sectional planes and the second blade surface is curved in both of the two perpendicular cross-sectional planes.

9. The fan impeller of claim 1, wherein the bead has a varying width and a varying depth along the curved path.

10. The fan impeller of claim 9, wherein the bead has a constantly varying cross-section along the curved path.

11. The fan impeller of claim 1, wherein the first and second supports comprise recesses that receive the first and second axial end sections of the blades, wherein each of the recesses is disposed at a base of a curved bead matched to a corresponding blade surface.

12. The fan impeller of claim 11, wherein the recesses of the first and second supports extend inward toward the blades.

13. The fan impeller of claim 1, wherein at least one of the first and second supports includes at least one impression.

14. The fan impeller of claim 13, wherein the at least one impression is star-shaped.

15. The fan impeller of claim 1, wherein the at least one bead extends radially inward toward the rotation axis.

16. The fan impeller of claim 1, wherein the at least one bead includes at least one bead extending radially inward toward the rotation axis and at least one bead extending radially outward away from the rotation axis.

17. The fan impeller of claim 1, wherein the boundary zone is offset radially inward toward the rotation axis relative to the inner zone.

18. The fan impeller of claim 1, wherein the first support comprises a plate-shaped or ring-shaped round sheet-metal blank for non-rotatable coupling to a drive shaft, and the second support comprises a ring with a curvature that is rotation-symmetrical to the rotation axis.

19. The fan impeller of claim 1, wherein second support comprises a torus ring section.

20. The fan impeller of claim 1, wherein the fan impeller is a radial impeller.

21. The fan impeller of claim 1, wherein the boundary zone and the inner zone respectively comprise first and second blade surfaces with differing geometries such that the first and second blade surfaces are offset from each other along at least a portion of a juncture therebetween.

22. A fan impeller for conveying a gaseous fluid, comprising:

first and second supports; and a plurality of blades having first and second axial end sections, each of the blades extending between the first and second supports and being respectively affixed to the first and second supports along the first and second axial end sections, the blades being arranged with a constant angular spacing in an annular space around a rotation axis;

wherein at least one of the blades has a continuous boundary zone extending along a periphery of the blade and at least one inner zone surrounded by the boundary zone; and wherein at least one bead lies between the boundary zone and the inner zone along a curved path having at least a portion that is substantially L-shaped, the bead having a constant width and a constant depth along the curved path.

* * * * *